US008302791B2

(12) United States Patent
Jiang et al.

(10) Patent No.: US 8,302,791 B2
(45) Date of Patent: Nov. 6, 2012

(54) DRAFT GEAR

(75) Inventors: Yan Jiang, Qiqihar Heilongjiang (CN); Qingmin Meng, Qiqihar Heilongjiang (CN); Yuebin Yu, Qiqihar Heilongjiang (CN); Long Chen, Qiqihar Heilongjiang (CN); Yingjun Ciu, Qiqihar Heilongjiang (CN); Junsong Wang, Qiqihar Heilongjiang (CN)

(73) Assignees: Oiqihar Railway Rolling Stock Co., Ltd., Heilongjiang (CN); Mudanjiang Jinyuan Coupler and Draft Gear Manufacturing Co., Ltd., Heilongjiang (CN)

( * ) Notice: Subject to any disclaimer, the term of this patent is extended or adjusted under 35 U.S.C. 154(b) by 0 days.

(21) Appl. No.: 13/142,743

(22) PCT Filed: Jul. 22, 2009

(86) PCT No.: PCT/CN2009/072862

§ 371 (c)(1),
(2), (4) Date: Jun. 29, 2011

(87) PCT Pub. No.: WO2010/083674

PCT Pub. Date: Jul. 29, 2010

(65) Prior Publication Data

US 2011/0266243 A1 Nov. 3, 2011

(30) Foreign Application Priority Data

Jan. 22, 2009 (CN) ..... 2009 1 0006054

(51) Int. Cl.
*B61G 3/00* (2006.01)

(52) U.S. Cl. ..... 213/211; 213/162; 213/166

(58) Field of Classification Search ..... 213/159, 213/162, 171, 211, 212, 161, 169
See application file for complete search history.

(56) References Cited

U.S. PATENT DOCUMENTS 1,246,222 A * 11/1917 Bazeley ..... 213/162
1,815,704 A * 7/1931 Cooke ..... 213/171
1,932,719 A * 10/1933 Bazeley ..... 213/169
1,986,440 A * 1/1935 Kinne ..... 213/127

(Continued)

FOREIGN PATENT DOCUMENTS

CN 1265071 A 8/2000

(Continued)

*Primary Examiner* — Jason C Smith
(74) *Attorney, Agent, or Firm* — Patterson Thuente Christensen Pedersen, P.A.

(57) ABSTRACT

A lower locking pin body for the hinge joint between a lower locking pin and a lower locking pin hook has a suspending hole of a coupler lock lifter to facilitate it rotating surrounding the lower locking pin hook under the effect of the hole. There are two coupler suspending holes which are respectively arranged on each side ends of the lower locking pin body to facilitate the workers opening the coupler on either side of a car. A two-side operating coupler with above said lower lock pin body and a draft gear are provided, wherein the draft gear also includes two lock lifters and two lock lifter seats. The lock lifters are mounted into a key-shaped hole of the lock lifter seats, and the lock lifter has a limiting segment on the matched position. Two hook head ends of the lock lifters pass respectively out from the key-shaped holes of the coupler lock lifter seats and hang with the coupler lock lifter suspension hole of the two-side operating coupler. It has clearance between the limiting segment of the coupler lock lifter and a stripe-shaped hole wall of the key-shaped hole.

6 Claims, 9 Drawing Sheets

U.S. PATENT DOCUMENTS

| | | | | | |
|---|---|---|---|---|---|
| 2,083,422 | A | * | 6/1937 | Bazeley | 213/167 |
| 2,803,354 | A | * | 8/1957 | Sale | 213/168 |
| 3,029,956 | A | * | 4/1962 | De Penti | 213/147 |
| 3,102,644 | A | * | 9/1963 | Cope | 213/166 |
| 3,227,289 | A | * | 1/1966 | Cseri | 213/219 |
| 3,762,575 | A | * | 10/1973 | Cseri | 213/166 |
| 4,398,641 | A | * | 8/1983 | Klimowicz | 213/109 |
| 5,927,522 | A | * | 7/1999 | Carifa | 213/166 |
| 2011/0266243 | A1 | * | 11/2011 | Jiang et al. | 213/211 |

FOREIGN PATENT DOCUMENTS

| | | | |
|---|---|---|---|
| CN | 201143950 | Y | 11/2008 |
| CN | 101475011 | A | 7/2009 |
| DE | 28 41 138 | A1 | 4/1980 |
| FR | 1.437.378 | | 5/1966 |
| GB | 897419 | | 5/1962 |

* cited by examiner

DRAFT GEAR

This application claims the benefit of the priority to Chinese Patent Application No. 200910006054.8 titled "LOWER LOCKING PIN BODY, TWO-SIDE OPERATING COUPLER AND DRAFT GEAR", filed with the Chinese States Intellectual Property Office on Jan. 22, 2009, the disclosure of which is incorporated herein by reference.

FIELD OF THE INVENTION

The present invention relates to coupling technology between carriages of a railcar, in particular, to a coupler draft gear.

BACKGROUND OF THE INVENTION

A coupler is one of important components of a car and has a standard connection contour, and the main functions thereof are to ensure coupling between cars and to realize train marshalling so as to draw the car.

Conventional coupler of the car generally has three operating states, i.e., locking state, uncoupling state and full open state, which are also referred to as three states. When a coupler is in the locking state, a coupler lock stops a coupler knuckle from being opened so that coupled cars wouldn't be disengaged spontaneously. When rotating an uncoupling lever, the coupler lock is pushed to an uncoupling position under an upward movement of a bottom locklift connector coupled with an uncoupling lever and a bottom locklift toggle. At this moment, the coupler is switched into the uncoupling state, and cars are disengaged when the coupler knuckle is opened under an external force. When lifting the uncoupling lever to a highest position, the coupler knuckle is pushed to the full open position under the action of the coupler knuckle thrower so that the coupler is switched into the full open state, and adjacent cars may be coupled. Two cars can be coupled with each other by themselves when they are colliding, and disengagement between coupled cars can be achieved by operating the uncoupling lever from outside. In this way, the operating efficiency of train marshalling can be increased and safety of operators can be ensured. Referring to FIG. 1, a schematic view of an existing 13-type bottom operating coupler in a use state is shown.

In hump shunting operation (seeing FIGS. 2*a* and 2*b*), an operator standing at the side of railroad line having signal display operates an uncoupling lever such that a back coupler of a humping car is in the uncoupling state. During humping, on the one hand, a speed reducer on the humping line will reduce humping speed of the humping car so as to ensure that the humping car would not exceed an allowable speed when being shunted and coupled; on the other hand, the humping car will collide with a standing car when they are to be coupled. Thus, under an inertia force of the humping car, a coupler knuckle of the back coupler of the humping car is likely returned towards the locking position around a coupler knuckle pin. In other words, the back coupler is in a non-full open position or in the locking position. However, at this time, a front coupler of a subsequent humping car is in the locking position. Therefore, the previous humping car cannot be successfully coupled with the subsequent humping car after the subsequent humping car runs downwardly, thereby reducing success rate of coupling in marshalling. As a result, the operation efficiency in marshalling is affected and the safety of operators is also affected.

In view of the above disadvantages, there is an urgent demand to develop a double-side operating coupler which is applicable to many operating conditions of train marshalling such as hump shunting.

SUMMARY OF THE INVENTION

In view of the above drawbacks, the technical problem to be solved by the present invention is to provide a coupler draft gear operated at both sides so as to achieve coupler operation at both sides of a car.

The coupler draft gear according to the present invention includes a coupler, uncoupling levers coupled with the uncoupling lever holes of the coupler and uncoupling lever brackets used cooperatively with the uncoupling levers. The coupler includes a coupler body, a coupler knuckle, a coupler knuckle thrower, a coupler knuckle pin, a coupler lock, a bottom locklift toggle, a bottom locklift connector and a bottom locklift hook. The bottom locklift connector is provided between the bottom locklift toggle and the bottom locklift hook in a hinged manner. The coupler is specifically a double-side operating coupler, and uncoupling lever holes are provided at ends of both sides of the bottom locklift connector of the coupler so as to allow the bottom locklift connector to rotate about the bottom locklift hook under the action of the uncoupling lever. There are two uncoupling lever brackets which are fixed on a car body at both sides of the coupler respectively, and each uncoupling lever bracket has a keyhole-shaped through hole. There are two uncoupling levers, and coupler head ends thereof are respectively coupled with the two uncoupling lever holes of the double-side operating coupler after passing through the keyhole-shaped through holes of the two uncoupling lever brackets respectively. Each uncoupling lever has a restrained segment at a position where the uncoupling lever is engaged with the keyhole-shaped through hole of corresponding uncoupling lever bracket, and the cross-section of the restrained segment of the uncoupling lever is of a rectangular shape matched with a rectangular cross-section of a lower portion of corresponding keyhole-shaped through hole. There is a gap between the restrained segment of each uncoupling lever and walls of a rectangular hole of respective keyhole-shaped through hole.

Preferably, the two uncoupling lever holes are opened towards the same direction.

Preferably, a ratio of a width to a height of the cross-section of the restrained segment of each uncoupling lever is ranged from 2/5 to 3/4 , and a ratio of the gap between the restrained segment of each uncoupling lever and the walls of the rectangular hole of corresponding keyhole-shaped through hole to the width of the cross-section of the restrained segment of the uncoupling lever is ranged from 1/10 to 1/8.

Preferably, the ratio of the width to the height of the cross-section of the restrained segment of each uncoupling lever is 1/2 , and the ratio of the gap between the restrained segment of each uncoupling lever and the walls of the rectangular hole of corresponding keyhole-shaped through hole to the width of the cross-section of the restrained segment of the uncoupling lever is 1/9.

Preferably, the ratio of the width to the height of the cross-section of the restrained segment of each uncoupling lever is 2/5 , and the ratio of the gap between the restrained segment of each uncoupling lever and the walls of the rectangular hole of corresponding keyhole-shaped through hole to the width of the cross-section of the restrained segment of the uncoupling lever is 1/10.

Preferably, the ratio of the width to the height of the cross-section of the restrained segment of each uncoupling lever is 3/4 , and the ratio of the gap between the restrained segment of each uncoupling lever and the walls of the rectangular hole of corresponding keyhole-shaped through hole to the width of the cross-section of the restrained segment of the uncoupling lever is 1/8.

Compared with the bottom locklift connector of the existing 13-type bottom operating coupler, the hinged relationships between the bottom locklift connector and the bottom locklift toggle and between the bottom locklift connector and the bottom locklift hook in the present invention may be achieved in the same manner as that in the prior art. The key point of the design according to the present invention lies in that two uncoupling lever holes are provided and are disposed at ends of both sides of the bottom locklift connector respectively, such that the operator standing at either side of the car body can reliably perform the uncoupling operation to the front and back couplers at connection end between two cars.

In hump shunting operation, the operator may stand at the side of railroad line having signal display and operate uncoupling levers of front and back couplers. During humping, even though the back coupler of the humping car is blocked so as to stay in a non-full open position or in a locking position, it is possible to ensure that the subsequent humping car is successfully coupled with the previous humping car after the subsequent humping car runs downwardly, since the front coupler of the subsequent humping car is in a full open position. Further, the success rate of coupling in marshalling can be ensured.

In a preferred technical solution of the bottom locklift connector according to the present invention, the two uncoupling lever holes are opened towards the same direction. Thus, rotation angles of the bottom locklift connector when the coupler is opened from both sides of the car are identical, which facilitates the operator's uncoupling operation to the coupler, has a better manufacturability and is applicable to mass production.

In the coupler draft gear according to the present invention, the uncoupling levers and the uncoupling lever brackets are provided at both sides of the coupler. When assembling, the coupler head ends of both uncoupling levers are coupled with uncoupling lever holes at both sides of the bottom locklift connector respectively after passing through the keyhole-shaped through holes of the uncoupling lever brackets respectively. When uncoupling the coupler, the uncoupling lever at one side is operated, and is rotated after the restrained segment thereof is lifted to the circular hole of the keyhole-shaped through hole, so as to rotate the bottom locklift connector. At this moment, the coupler is opened. Meanwhile, the coupler heads of the uncoupling levers are coupled with the uncoupling lever holes. When the uncoupling lever at said side is lifted, the coupler head end of the uncoupling lever at the opposite side is also lifted but will not be rotated. In addition, since there is a gap between the restrained segment of the uncoupling lever and walls of the rectangular hole of the keyhole-shaped through hole, when the uncoupling lever at said side is rotated, the uncoupling lever at the opposite side is swayable in the rectangular hole of the keyhold-shaped through hole of the uncoupling lever bracket, and vice verse.

To sum up, in the present invention, when the uncoupling lever at either side is operated to open the coupler, the uncoupling levers would not interfere with each other and thus would not affect the use and the performance of the coupler, so the coupler can be operated reliably. Further, the uncoupling lever brackets with keyhole-shaped holes are provided for respective uncoupling levers at both sides so as to obtain good anti-disengaging performance.

BRIEF DESCRIPTION OF THE DRAWINGS

FIG. 2 is a schematic view illustrating hump shunting operation, in which

FIG. 5 shows three operating states of a double-side operating coupler according to the present invention, in which

Figure 1:
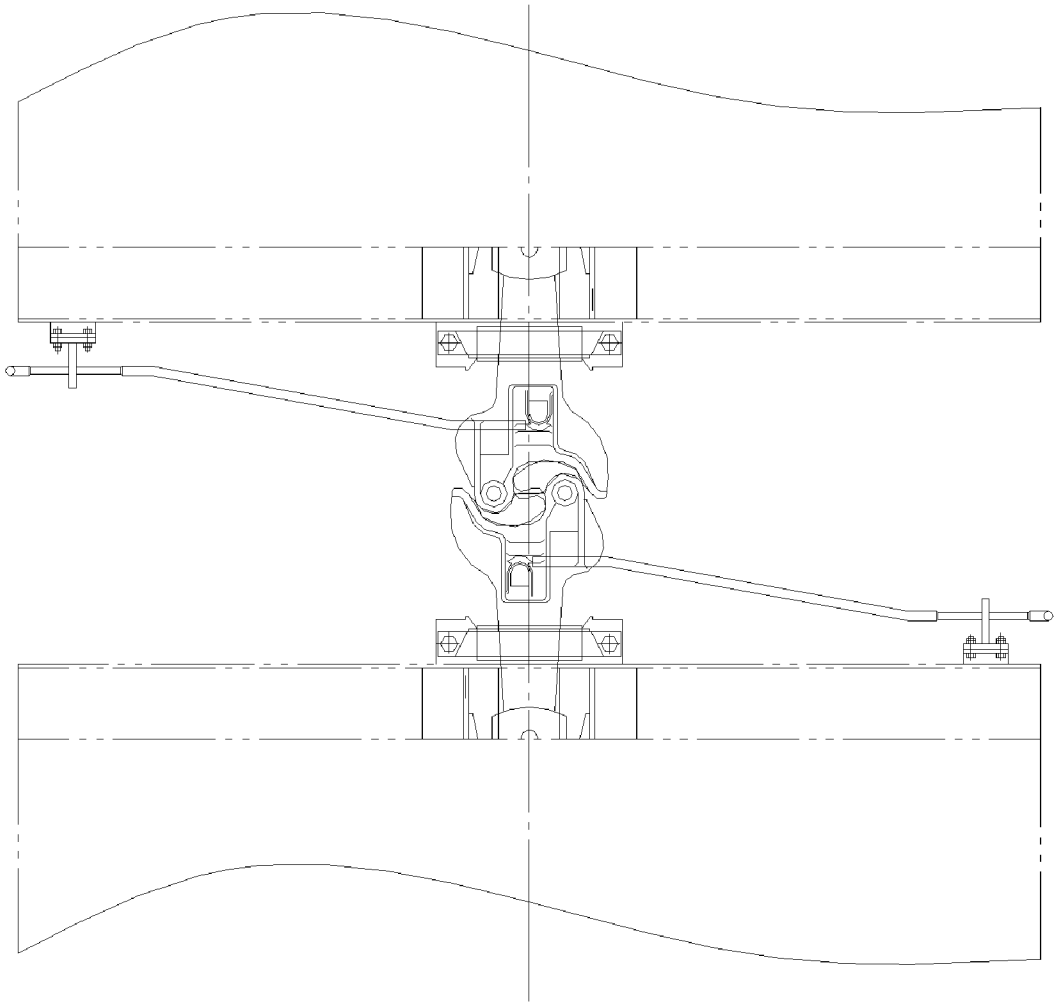
FIG. 1 is a schematic view of an existing 13-type bottom operating coupler in an use state.
Figure 2A:
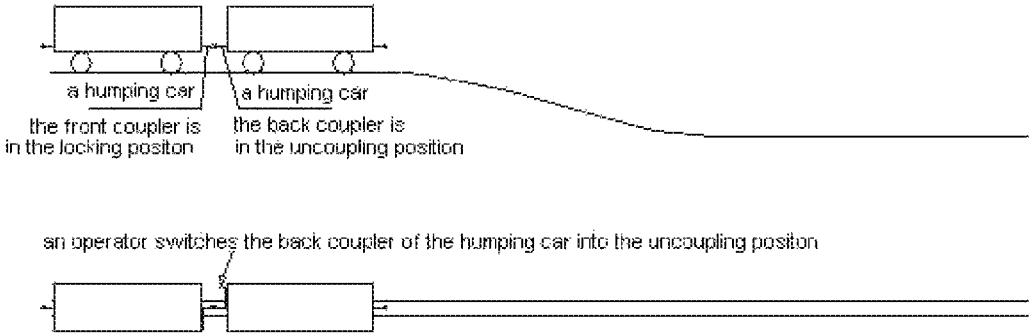
FIG. 2*a* shows an operating state before humping.
Figure 2B:
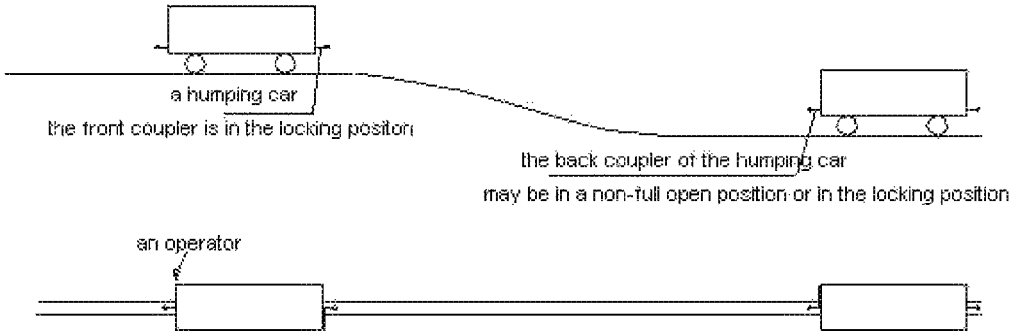
FIG. 2*b* shows an operating state after humped.

| Reference numerals in FIGS. 3 to 7: | |
|---|---|
| 1. bottom locklift connector | 11, 12. uncoupling lever hole |
| 13. first hinge hole | 14. second hinge hole |
| 2. coupler body | 3. coupler knuckle |
| 4. coupler lock | 5. bottom locklift toggle |
| 6. bottom locklift hook | 10. double-side operating coupler |
| 20. uncoupling lever | 30. uncoupling lever bracket |
| 40. car body | |

DETAILED DESCRIPTION

The object of the present invention is to provide a bottom locklift connector which has two uncoupling lever holes and is hinged between a bottom locklift toggle and a bottom locklift hook of the coupler so that the bottom locklift connector is respectively coupled with uncoupling levers provided at two sides of the coupler, thereby meeting the need that the coupler may be opened from two sides thereof so as to be applicable to many operating conditions of train marshalling such as hump shunting.

Hereinafter, the present embodiment will be specifically described with reference to the drawings in the specification.

Figure 3A:
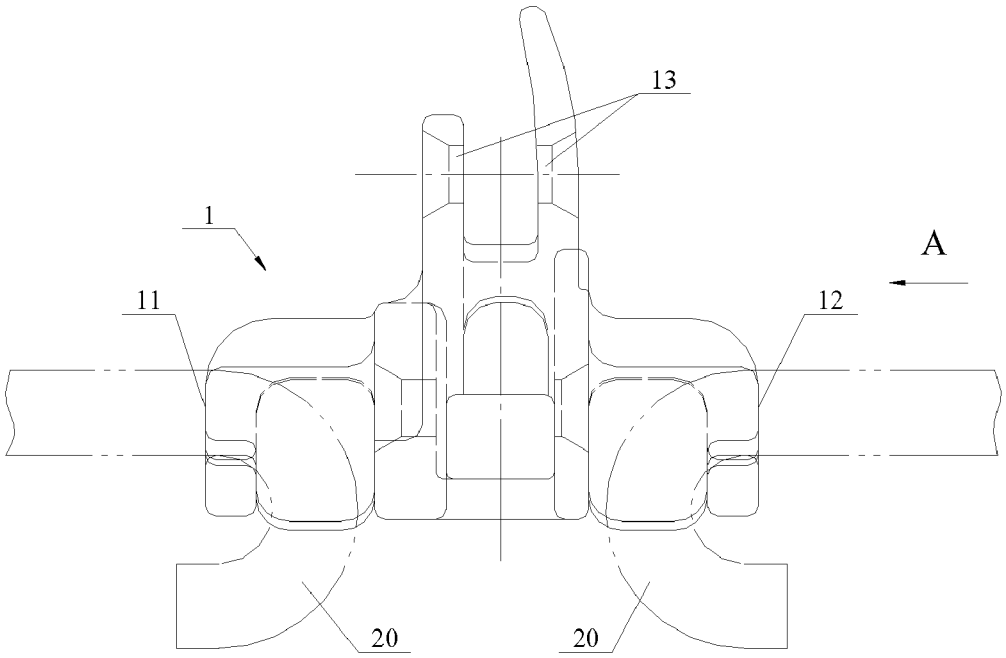
FIG. 3*a* is a front view of a bottom locklift connector according to the present invention.
Figure 3B:
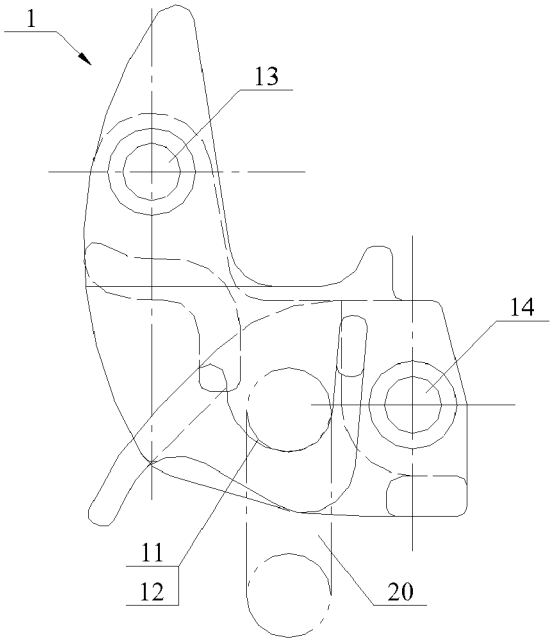
FIG. 3*b* is a view seeing from direction A of FIG. 3*a;*

Referring to FIGS. 3*a* and 3*b*, FIG. 3*a* is a front view of a bottom locklift connector according to the present invention, and FIG. 3*b* is a view seeing from direction A of FIG. 3*a*.

As shown in FIG. 3*a*, the bottom locklift connector 1 has two uncoupling lever holes 11, 12 provided respectively at ends of both sides of the bottom locklift connector 1.

With reference to FIG. 3*b*, the contour structure sizes of the bottom locklift connector 1 according to the present embodiment are approximately the same as that of a bottom locklift connector 1 of the existing 13-type bottom operating coupler to match with spatial sizes of a lower cavity of a coupler body engaged with the bottom locklift connector, so as to be able to ensure the reliability of the cooperation movements between the bottom locklift connector and the bottom locklift toggle, and between the bottom locklift connector and the bottom locklift hook during transforming among three states of the coupler. As shown in the figures, a first hinge hole 13 at the upper portion of the left side of the bottom locklift connector 1 is configured to be hinged with the bottom locklift toggle, and a second hinge hole 14 at the lower portion of the right side of the bottom locklift connector 1 is configured to be hinged with the bottom locklift hook.

In other words, the motion track of the bottom locklift connector 1 according to the present invention is the same as that of the existing 13-type coupler.

Further, the two uncoupling lever holes 11, 12 are opened towards the same direction. Thus, rotation angles of the bottom locklift connector 1 when the coupler is opened from either side of the car are identical, which facilitates the operator's operation to the coupler simultaneously, has a better manufacturability and is suitable for mass production.

Figure 4:
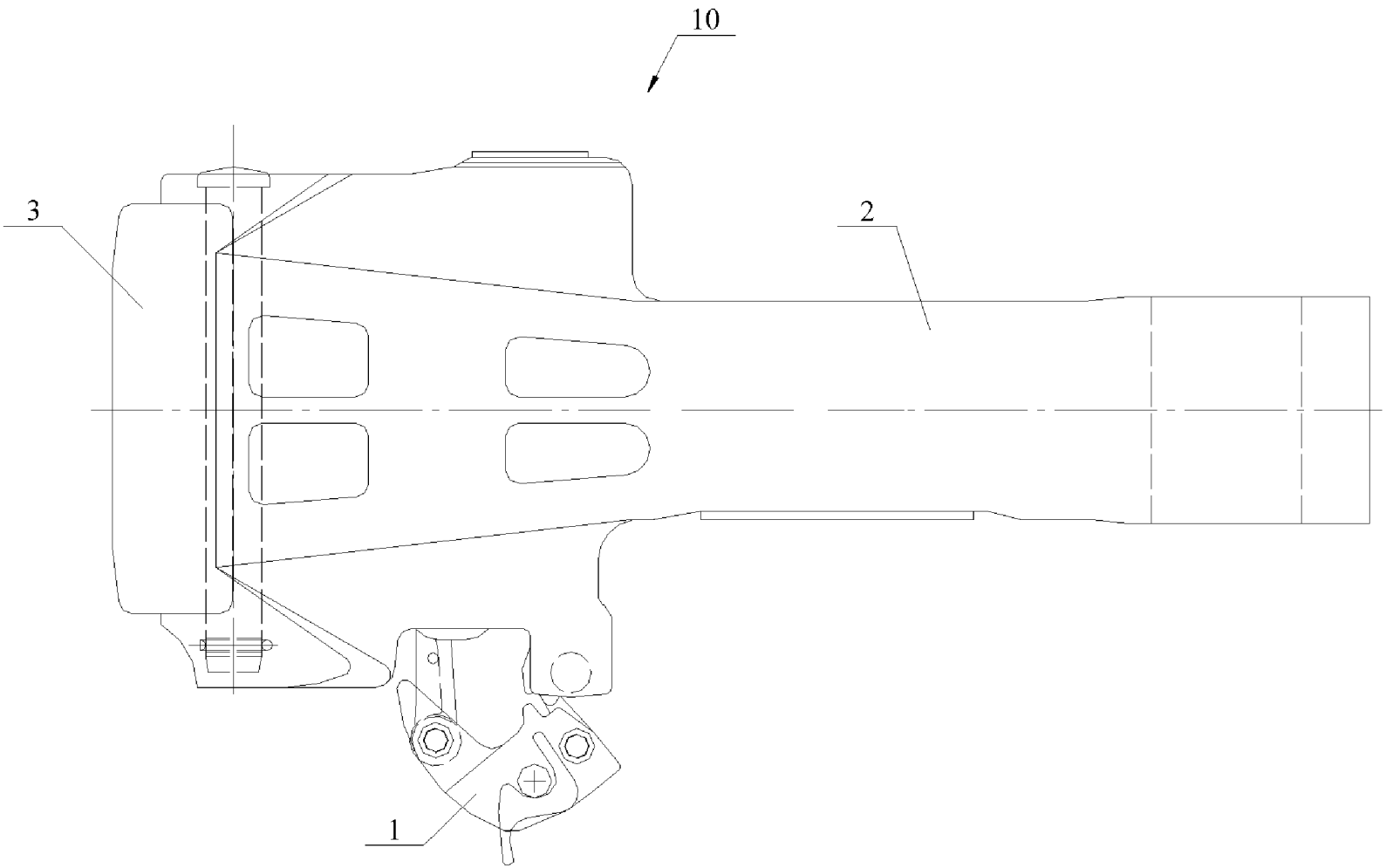
FIG. 4 is a schematic view of an overall structure of a double-side operating coupler according to the present invention.

The present embodiment further provides a double-side operating coupler 10, including main components such as a coupler body 2, a coupler knuckle 3, a coupler knuckle thrower, a coupler knuckle pin, a coupler lock 4, a bottom locklift toggle 5, a bottom locklift connector 1 and a bottom locklift hook 6. The structures of the bodies of the coupler body 2, the coupler knuckle 3, the coupler knuckle thrower, the coupler knuckle pin, the coupler lock 4, the bottom locklift toggle 5 and the bottom locklift hook 6 and so on are completely the same as that of the existing 13-type bottom operating coupler, and the machining and assembling of the aforementioned components may be performed by those skilled in the art based on the prior art. Thus, the aforementioned components will not be specifically described herein. Referring to FIG. 4, a schematic view of the overall structure of a double-side operating coupler according to the present invention is shown.

Figure 5A:
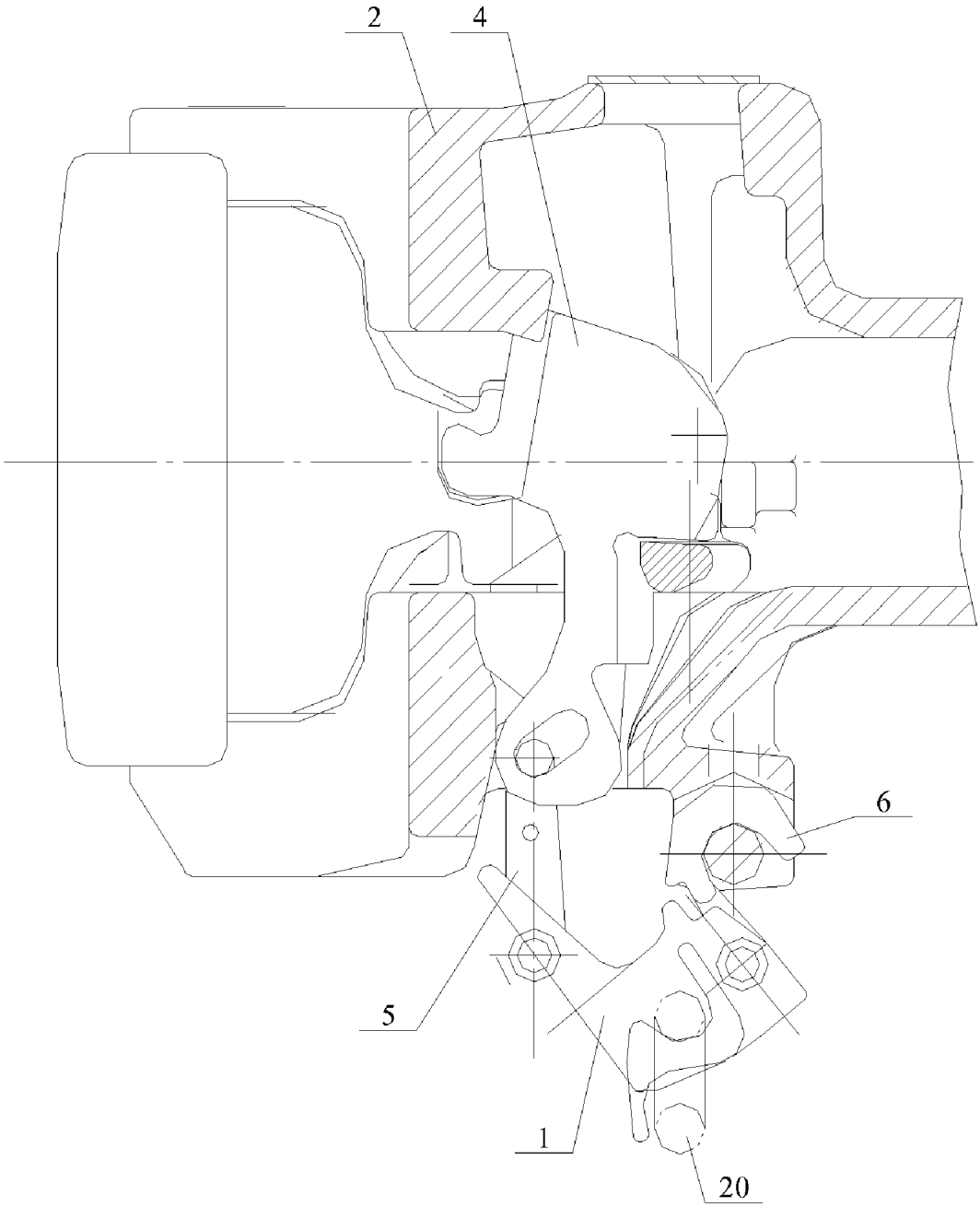
FIG. 5*a* shows a locking state.
Figure 5B:
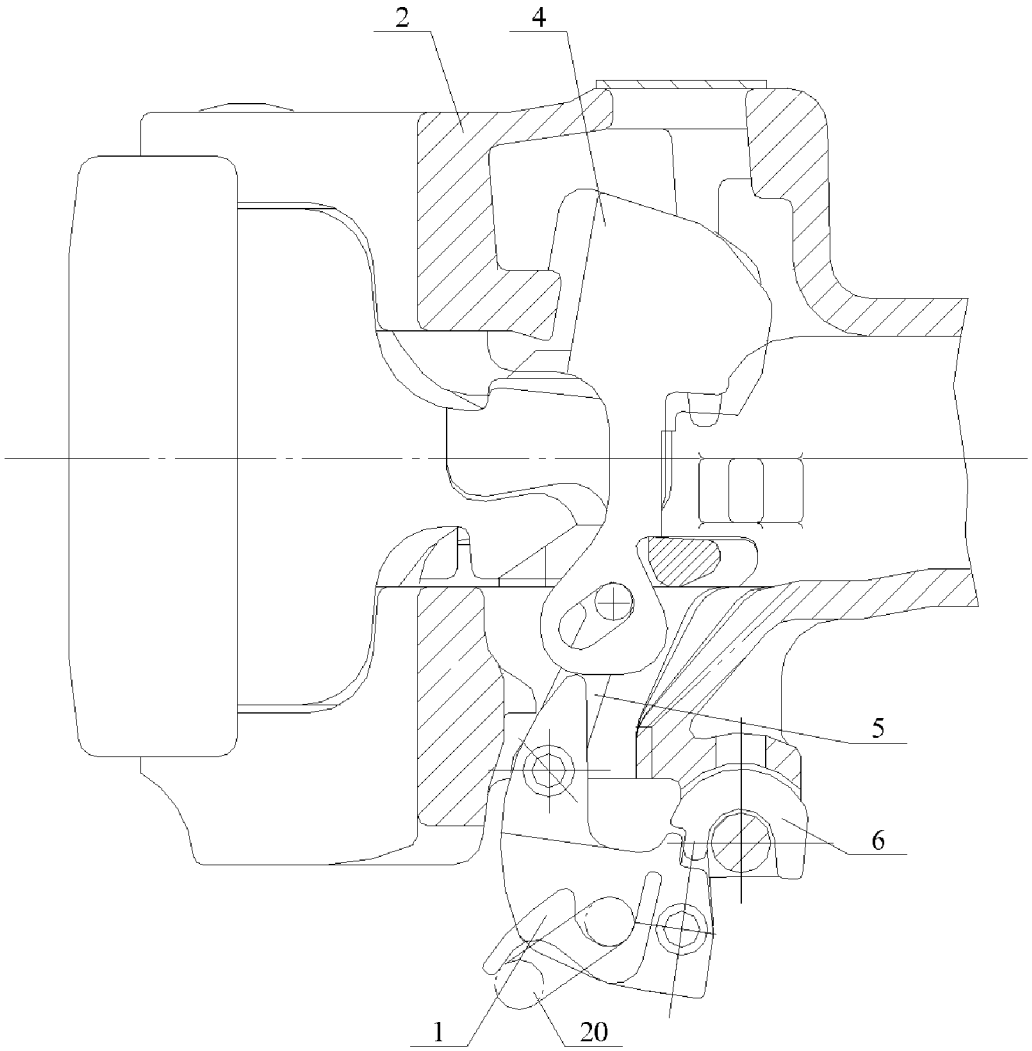
FIG. 5*b* shows an uncoupling state and FIG. 5*c* shows a full open state.
Figure 5C:
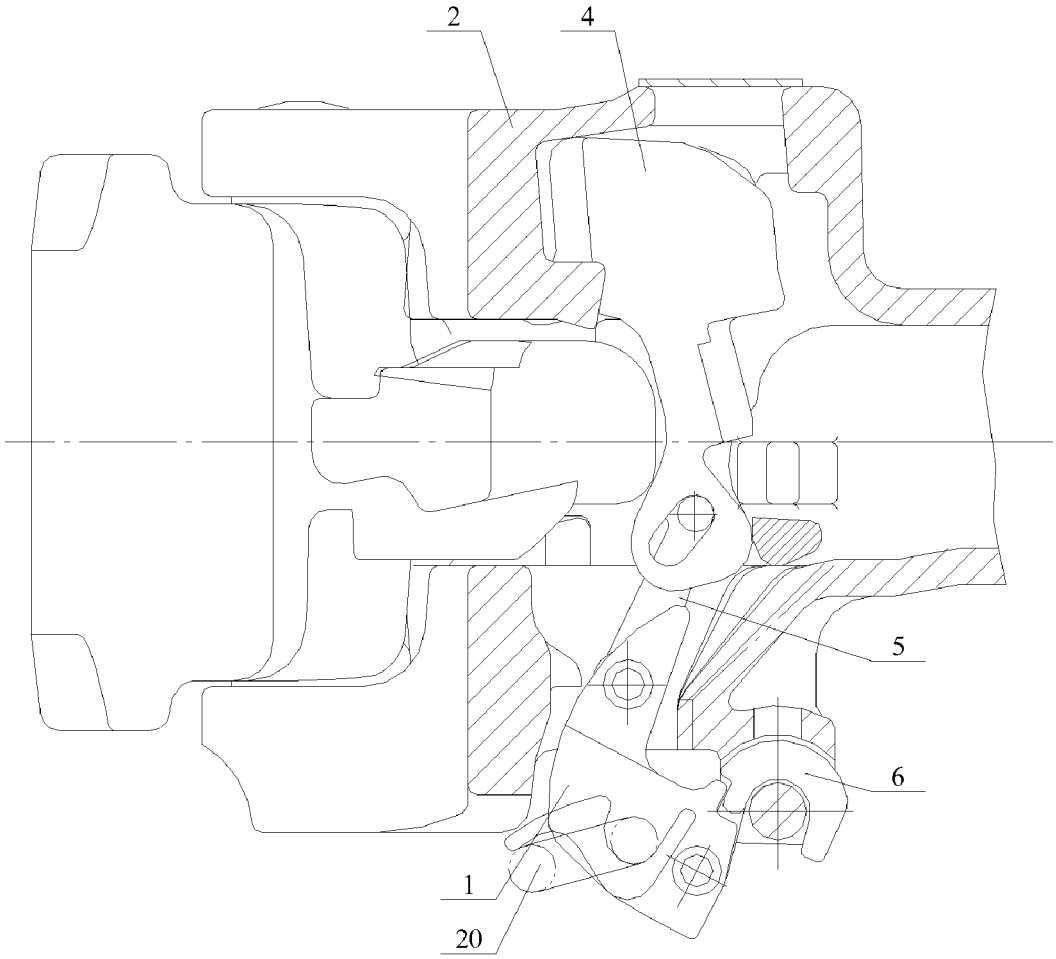

Also referring to FIG. 5, FIG. 5 shows three operating states of the double-side operating coupler according to the present invention, in which FIG. 5*a* shows a locking state, FIG. 5*b* shows an uncoupling state and FIG. 5*c* shows a full open state.

As shown in the figures, the bottom locklift connector 1 is a bottom locklift connector aforementioned, and is provided between the bottom locklift toggle 5 and the bottom locklift hook 6 in a hinged manner.

Figure 6:
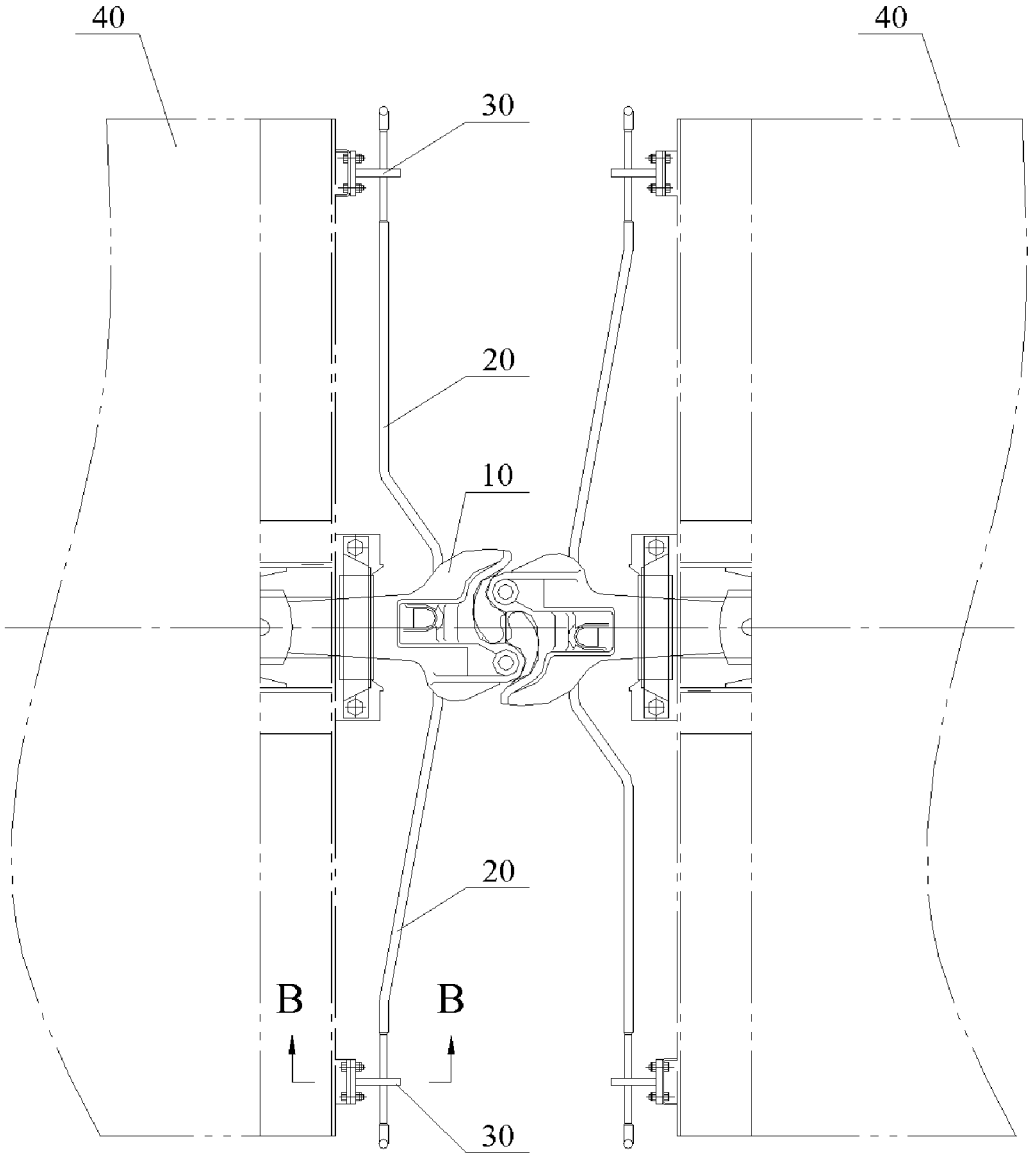
FIG. 6 is schematic view of a coupler draft gear according to the present invention in a use state.
Figure 7:
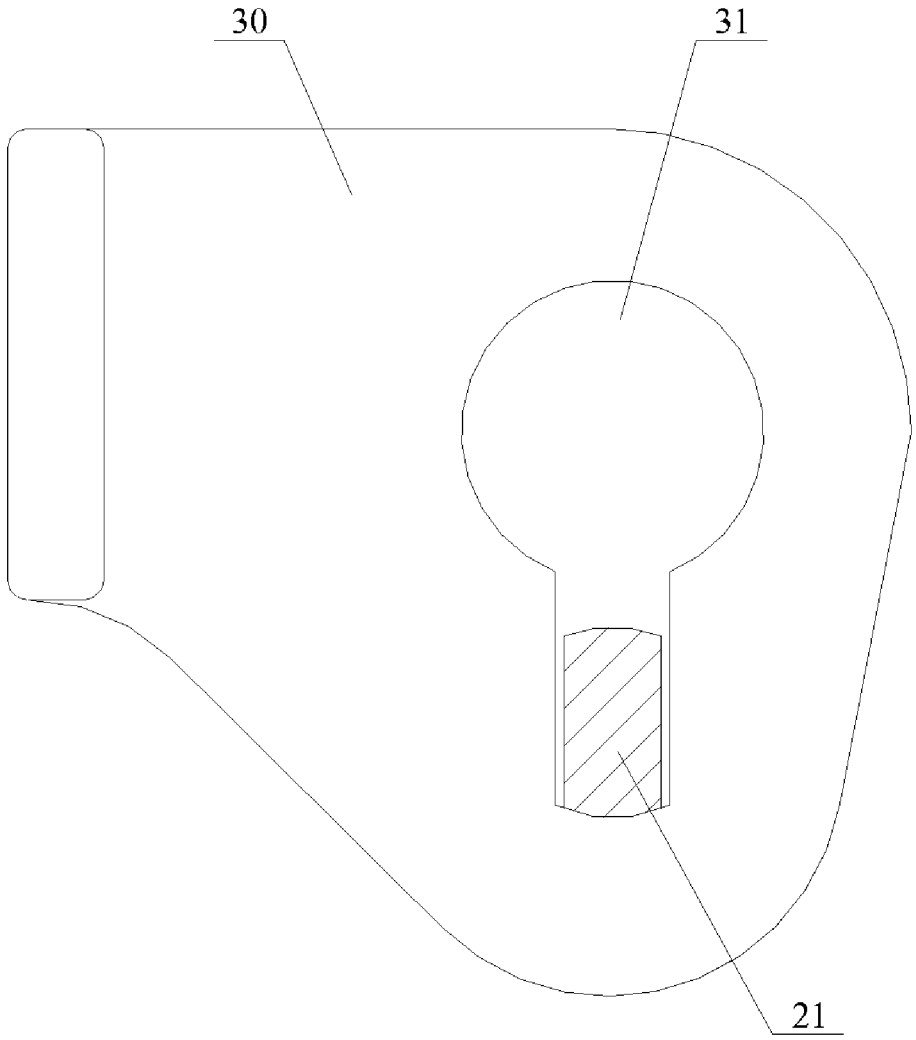
FIG. 7 is a sectional view taken along line B-B of FIG. 6.

Referring to FIG. 6, a schematic view of a coupler draft gear according to the present invention in a use state is shown.

As shown in FIG. 6, the coupler draft gear according to the present invention includes a double-side operating coupler 10, uncoupling levers 20 coupled with uncoupling lever holes of the coupler 10 respectively and uncoupling lever brackets 30 used cooperatively with uncoupling levers 20 respectively.

The structures of the uncoupling lever 20 and the uncoupling lever bracket 30 and the fitting relationships among the uncoupling lever 20, the uncoupling lever bracket 30 and the associated components are approximately the same as that of the existing 13-type bottom operating coupler. Please also refer to FIG. 7 which is a sectional view taken along line B-B of FIG. 6.

As shown in the figures, the uncoupling lever bracket 30 has a keyhole-shaped through hole 31 which consists of a circular hole at the upper portion thereof and a rectangular hole at the lower portion thereof. The uncoupling lever 20 is inserted through the keyhole-shaped through hole 31 of the uncoupling lever bracket 30 and has a restrained segment 21 at a position where the uncoupling lever is engaged with the uncoupling lever bracket 30. The cross-section of the restrained segment 21 of the uncoupling lever is of a rectangular shape matched with the rectangular cross-section at the lower portion of the keyhole-shaped through hole 31. There are two uncoupling lever brackets 30 fixedly disposed on the car body 40 at both sides of the coupler 10, respectively. There are two uncoupling levers 20. The coupler head ends of the uncoupling levers 20 are respectively coupled with two uncoupling lever holes (not shown) of the double-side operating coupler 10 after the coupler head ends respectively pass through the keyhole-shaped through holes 31 of the two uncoupling lever brackets. There is a gap between the restrained segment 21 of the uncoupling lever and walls of the rectangular hole of the keyhole-shaped through hole 31.

In order to ensure a reliable motion relationship between the uncoupling levers at both sides, in the present invention, the ratio $\alpha$ of a width to a height of the cross-section of the restrained segment of the uncoupling lever, and the ratio $\beta$ of the gap between the restrained segment of the uncoupling lever and the walls of the rectangular hole of the keyhole-shaped through hole to the width of the cross-section of the restrained segment of the uncoupling lever are optimized. For example, $\alpha$ is 1/2 and $\beta$ is 1/9 ; $\alpha$ is 2/5 and $\beta$ is 1/10 ; and $\alpha$ is 3/4 and $\beta$ is 1/8.

It is noted that, both ratios $\alpha$ and $\beta$ are not limited to the three groups of values mentioned above. $\alpha$ may be ranged from 2/5 to 3/4 and $\beta$ may be ranged from 1/10 to 1/8 , which are deemed to fall into the protection scope of the present invention.

When assembling, the coupler is firstly mounted on a draft sill; the coupler head ends of both uncoupling levers are then coupled with the uncoupling lever holes at both sides of the bottom locklift connector respectively after passing through the keyhole-shaped through holes of the uncoupling brackets respectively; and the uncoupling lever brackets are finally fixed on an end wall of the car body. When uncoupling the coupler, the uncoupling lever at one side is operated, and is rotated after the restrained segment thereof is lifted to the circular hole of the keyhole-shaped through hole, so as to rotate the bottom locklift connector. At this moment, the coupler is opened. Simultaneously, the coupler heads of the uncoupling levers are coupled with the uncoupling holes. When the uncoupling lever at said side is lifted, the coupler head end of the uncoupling lever at the opposite side is also lifted but will not be rotated. Furthermore, since there is a gap between the restrained segment of the uncoupling lever and walls of the rectangular hole of the keyhole-shaped through hole, when the uncoupling lever at said side is rotated, the uncoupling lever at the opposite side is swayable in the rectangular hole of the keyhole-shaped through hole of the uncoupling lever bracket.

To sum up, the uncoupling levers according to the present invention would not interfere with each other when the uncoupling lever at either side is operated to uncouple the coupler, and thereby can be operated reliably. Further, the coupler may be opened from both sides of the coupler without reducing the anti-disconnecting performance, since uncoupling lever brackets with keyhole-shaped holes are provided for the corresponding uncoupling levers at both sides of the coupler.

It is noted that, the technical solutions of the present invention are applicable to new manufactured cars, and are applied to improve conventional cars. When improving the conventional cars, it is only need to replace the bottom locklift connector, while the other structures and components of the coupler are unchanged. Thereby the structures of the technical solutions of the present invention are simple and reliable.

The above description is only the preferred embodiments of the present invention. It should be noted that, those skilled in the art can also make many improvements and modifications without departing from the principle of the present invention, and these improvements and modifications should also be deemed to fall into the protection scope of the present invention.

What is claimed is:

1. A coupler draft gear, comprising a coupler, uncoupling levers coupled with uncoupling lever holes of the coupler and uncoupling lever brackets used cooperatively with the uncoupling levers, the coupler comprising a coupler body, a coupler knuckle, a coupler knuckle thrower, a coupler knuckle pin, a coupler lock, a bottom locklift toggle, a bottom locklift connector and a bottom locklift hook, the bottom locklift connector being provided between the bottom locklift toggle and bottom locklift hook in a hinged manner; characterized in that:

the coupler is a double-side operating coupler, and uncoupling lever holes are provided at ends of both sides of the bottom locklift connector of the coupler so as to allow the bottom locklift connector to rotate about the bottom locklift hook under the action of the uncoupling lever;

there are two uncoupling lever brackets which are fixed on a car body at both sides of the coupler respectively, and each uncoupling lever bracket has a keyhole-shaped through hole;

each uncoupling lever has a restrained segment at a position where the uncoupling lever is engaged with the keyhole-shaped through hole of corresponding uncoupling lever bracket, and the cross-section of the restrained segment of the uncoupling lever is of a rectangular shape matched with a rectangular cross-section of a lower portion of corresponding keyhole-shaped through hole, and there is a gap between the restrained segment of each uncoupling lever and walls of a rectangular hole of corresponding keyhole-shaped through hole.

2. The coupler draft gear according to claim 1, wherein the two uncoupling lever holes are opened towards the same direction.

3. The coupler draft gear according to claim 2, wherein a ratio of a width to a height of the cross-section of the restrained segment of each uncoupling lever is ranged from 2/5 to 3/4, and a ratio of the gap between the restrained segment of each uncoupling lever and the walls of the rectangular hole of corresponding keyhole-shaped through hole to the width of the cross-section of the restrained segment of the uncoupling lever is ranged from 1/10 to 1/8.

4. The coupler draft gear according to claim 3, wherein the ratio of the width to the height of the cross-section of the restrained segment of each uncoupling lever is 1/2, and the ratio of the gap between the restrained segment of each uncoupling lever and the walls of the rectangular hole of corresponding keyhole-shaped through hole to the width of the cross-section of the restrained segment of the uncoupling lever is 1/9.

5. The coupler draft gear according to claim 3, wherein the ratio of the width to the height of the cross-section of the restrained segment of each uncoupling lever is 2/5, and the ratio of the gap between the restrained segment of each uncoupling lever and the walls of the rectangular hole of corresponding keyhole-shaped through hole to the width of the cross-section of the restrained segment of the uncoupling lever is 1/10.

6. The coupler draft gear according to claim 3, wherein the ratio of the width to the height of the cross-section of the restrained segment of each uncoupling lever is 3/4, and the ratio of the gap between the restrained segment of each uncoupling lever and the walls of the rectangular hole of corresponding keyhole-shaped through hole to the width of the cross-section of the restrained segment of the uncoupling lever is 1/8.

* * * * *

UNITED STATES PATENT AND TRADEMARK OFFICE

CERTIFICATE OF CORRECTION

PATENT NO. : 8,302,791 B2
APPLICATION NO. : 13/142743
DATED : November 6, 2012
INVENTOR(S) : Yan Jiang et al.

It is certified that error appears in the above-identified patent and that said Letters Patent is hereby corrected as shown below:

Title page

Item (75) Inventors should read: Yan Jiang, Qiqihar Heilongjiang (CN); Qingmin Meng, Qiqihar Heilongjiang (CN); Yuebin Yu, Qiqihar Heilongjiang (CN); Long Chen, Qiqihar Heilongjiang (CN); ~~Yingjun Ciu, Qiqihar~~ Yingjun Cui, Qiqihar Heilongjiang (CN); Junsong Wang, Qiqihar Heilongjiang (CN)

Signed and Sealed this
Twenty-ninth Day of January, 2013

David J. Kappos

David J. Kappos
*Director of the United States Patent and Trademark Office*